US011326218B2

(12) United States Patent
Waning et al.

(10) Patent No.: US 11,326,218 B2
(45) Date of Patent: May 10, 2022

(54) COOLING DEVICE AND METHOD FOR COOLING ELEMENTS PASSING THROUGH SAID DEVICE

(71) Applicant: LINDE AKTIENGESELLSCHAFT, Munich (DE)

(72) Inventors: Gerd Waning, Bad Salzuflen (DE); Sebastian Berger, Vaterstetten (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 444 days.

(21) Appl. No.: 16/324,791

(22) PCT Filed: Jul. 31, 2017

(86) PCT No.: PCT/EP2017/025224
§ 371 (c)(1),
(2) Date: Feb. 11, 2019

(87) PCT Pub. No.: WO2018/028835
PCT Pub. Date: Feb. 15, 2018

(65) Prior Publication Data

US 2019/0226038 A1 Jul. 25, 2019

(30) Foreign Application Priority Data

Aug. 11, 2016 (EP) ..... 16001787

(51) Int. Cl.
*C21D 1/613* (2006.01)
*C21D 1/18* (2006.01)
(Continued)

(52) U.S. Cl.
CPC ..... *C21D 1/613* (2013.01); *C21D 1/18* (2013.01); *C21D 9/5732* (2013.01);
(Continued)

(58) Field of Classification Search
CPC . C21D 1/18; C21D 1/613; C21D 1/62; C21D 9/5732; F27D 15/0206; F27D 2009/0081
(Continued)

(56) References Cited

U.S. PATENT DOCUMENTS 4,437,870 A * 3/1984 Miller ..... C03B 37/02718 65/157
4,514,205 A * 4/1985 Darcangelo ..... C03B 37/02718 65/158
(Continued)

FOREIGN PATENT DOCUMENTS

DE 3501463 A1 7/1986
DE 102011109534 A1 2/2013
(Continued)

OTHER PUBLICATIONS

International Search Report for PCT/EP2017/025224 dated Sep. 19, 2017.
(Continued)

*Primary Examiner* — Jessee R Roe
*Assistant Examiner* — Michael Aboagye
(74) *Attorney, Agent, or Firm* — Millen White Zelano & Branigan, PC; Brion P. Heaney

(57) ABSTRACT

The invention relates to a cooling device (100) for cooling at least one element (150, 151) passing through said device, comprising a metal block (115), having a first side and a second side, and comprising a cooling channel (130) for cyrogenic gas. The at least one element (150, 151) can be guided along the sides of the first side of the metal block (115), the cooling channel (130) is at least partially in heat conductive connection with the second side of the metal block (115), and the cooling channel (130) has an attachment (131) on a first end for the entry of cryogenic gas and an attachment on a second end for the exit of cryogenic gas.
(Continued)

The invention also comprises a hardening device having such a cooling device (100) and a method for cooling at least one element (150, 151) passing through said device.

22 Claims, 4 Drawing Sheets

(51) Int. Cl.

| | |
|---|---|
| ***F27D 15/02*** | (2006.01) |
| ***C21D 9/573*** | (2006.01) |
| *F27D 9/00* | (2006.01) |
| *F27D 19/00* | (2006.01) |
| *C21D 1/62* | (2006.01) |

(52) U.S. Cl.
CPC ..... *F27D 15/0206* (2013.01); *C21D 1/62* (2013.01); *F27D 2009/0078* (2013.01); *F27D 2009/0081* (2013.01); *F27D 2015/0233* (2013.01); *F27D 2019/0031* (2013.01); *F27D 2019/0056* (2013.01)

(58) Field of Classification Search
USPC ..... 266/260, 259; 65/115, 434; 148/559, 148/568, 574
See application file for complete search history.

(56) References Cited

U.S. PATENT DOCUMENTS

| | | | | |
|---|---|---|---|---|
| 4,664,689 | A * | 5/1987 | Davis | F25D 3/11 65/434 |
| 4,838,918 | A * | 6/1989 | Vaughan | C03B 37/02718 65/157 |
| 4,966,615 | A * | 10/1990 | Linden | C03B 37/02718 65/434 |
| 6,789,400 | B2 * | 9/2004 | Lu | C03B 37/02718 165/72 |
| 2003/0205066 | A1 | 11/2003 | Ghani et al. | |

FOREIGN PATENT DOCUMENTS

| | | | |
|---|---|---|---|
| JP | S6465048 | A | 3/1989 |
| WO | 2013020793 | A2 | 2/2013 |

OTHER PUBLICATIONS

English Abstract of DE3501463, Publication Date: Jul. 17, 1986.
English Abstract of JPS6465048, Publication Date: Mar. 10, 1989.

* cited by examiner

COOLING DEVICE AND METHOD FOR COOLING ELEMENTS PASSING THROUGH SAID DEVICE

The invention relates to a cooling device and a method for cooling at least one element, for example a strip or wire, passing through said cooling device, as well as to a hardening device with such a cooling device for hardening at least one element passing through said hardening device.

PRIOR ART

Hard steels, which allow a high cutting efficiency for a long period of time, are required for the manufacture of razor blades and the like. Steel can be hardened for this purpose. During the course of such a hardening process, the steel is initially heated to the austenitizing temperature and subsequently quenched, wherein the steel is then additionally cooled and ultimately tempered.

In order to harden steel for such blades as quickly and efficiently as possible, the steel is processed, for example, in the form of a strip that can pass through the different process stages. In the aforementioned additional cooling process, which particularly serves for adjusting the retained austenite, it is common practice to use cooling devices that operate with a cooling compressor and a corresponding coolant. However, such cooling devices are very energy-intensive because the energy input increases proportionally as the temperatures to be reached decrease. In addition, the coolant is harmful to the environment and the climate and the cooling devices require intensive maintenance due to the compressors used.

Materials other than steel may require different process sequences that, however, also include a cooling step. Consequently, this application generally refers to the cooling of a passing element such as the aforementioned steel strip, a metal strip or a metal wire.

It would therefore be desirable to disclose an option for cooling such passing elements as energy-efficient as possible and/or in a more environmentally compatible manner.

This objective is attained by means of a method and a device for cooling at least one element passing through said device and a hardening device with the characteristics of the independent claims.

Advantages of the Invention

An inventive cooling device serves for cooling at least one element passing through said cooling device. In this case, the element may particularly be a strip, especially a metal strip in the form of a blade strip and/or steel strip. However, the element may conceivably also be a wire, particularly a metal wire. For this purpose, the cooling device comprises a metal plate with a first side and a second side, as well as a cooling channel for cryogenic gas. In this case, the at least one element can be guided along the first side of the metal plate. It is advantageous if the at least one element directly rests on and is guided along the first side of the metal plate. However, it would also be conceivable that the metal plate is provided with a coating or a base material, on which the element can be guided. In any case, the metal plate and the passing element are in thermally conductive contact.

The cooling channel is at least sectionally connected to the metal plate, particularly to the second side of the metal plate, in a thermally conductive manner. In this case, the second side may particularly lie opposite of the first side.

The cooling channel may be realized in the form of a pipeline or a cooling channel that is machined into the metal plate or into an additional metal plate, which is connected to the metal plate in a thermally conductive manner. For example, the exact contour of the cooling channel may be milled into the metal plate for this purpose, wherein the open upper side is tightly sealed with an additional metal plate (e.g. by means of soldering). The cooling channel, particularly the pipeline, may be made of a material that contains copper or aluminum. These metals are very good thermal conductors and therefore transfer the cooling energy of the cryogenic gas, particularly of the nitrogen, to the metal plate very well. The thermally conductive connection may be realized in such a way that the cooling channel is directly attached, for example soldered, to the second side of the metal plate. However, it would also be conceivable that the cooling channel is attached, for example soldered or welded, to an intermediate plate that is particularly made of the same material as the cooling channel. This makes it possible to achieve greater flexibility in the design of the cooling device. In addition, the cooling line can thereby be attached with enhanced thermal conductivity because two identical materials are connected to one another. It goes without saying that this intermediate plate is connected to the metal plate in a thermally conductive manner. For this purpose, it would be conceivable to realize both plates in a planar manner and to place the two plates on top of one another. However, the use of a thermally conductive paste or the like may also be advantageous in this case. The metal plate preferably comprises hard metal, copper or brass. In this way, the metal plate is not only subjected to minimal wear by the passing strip, but maximal cooling of the metal plate and therefore the strip is also ensured.

In addition, the cooling channel comprises a connection for introducing cryogenic gas on a first end and a connection for discharging cryogenic gas on a second end. This ensures that cryogenic gas can be supplied to and discharged from the cooling device. It should be noted that it is advantageous to arrange the described components in a housing, which is insulated with respect to thermal conduction, in order to minimize energy losses as described in greater detail further below. The cryogenic gas may particularly consist of nitrogen that is introduced into the cooling channel, for example, in liquid form. The nitrogen can then preferably be discharged in gaseous form.

It goes without saying that, depending on the respective design, the cooling device is not only capable of cooling one element, but also multiple elements, for example two, three, four or even more elements. A combination of strips and wires would also be conceivable. Other elements with suitable cross section could also be cooled. For this purpose, the corresponding components, particularly the metal plate, can be correspondingly dimensioned and contoured in order to produce the largest contact surface possible between the metal plate and the passing element or elements. However, it would also be conceivable to use multiple metal plates adjacent to one another.

The invention utilizes the fact that very effective cooling can be achieved by means of the cryogenic gas, particularly the evaporation of liquid nitrogen. If liquid hydrogen is used, the liquid hydrogen transforms into the gaseous state in the cooling channel and in the process cools the cooling channel and therefore the metal plate, which is connected to the cooling channel in a thermally conductive manner. This allows very effective cooling of the at least one element being—directly or indirectly—guided along the metal plate.

The proposed solution therefore concerns indirect contact cooling with liquid nitrogen or other cryogenic gases. Indirect contact cooling provides a few advantages in comparison with direct cooling, in which liquid nitrogen or another cryogenic gas is directly applied to the parts to be cooled. The gas used for the cooling process particularly can be reused without being contaminated with other gases. For this purpose, the gas being discharged from the cooling channel can be respectively collected or conveyed onward otherwise. A few preferred options in this respect are described in greater detail further below. The gas particularly is not released into the environment, for example a factory building. In direct gas cooling, in contrast, the cryogenic gas such as liquid nitrogen evaporates during the cooling process and is directly released into the environment. In this case, it is difficult to collect the gas, particularly such that its original purity is maintained.

According to the invention, the at least one passing element is cooled by means of contact cooling with the metal plate. This means that the passing element is in thermally conductive contact with the metal plate and cooling of the passing element is realized by means of thermal conduction rather than convection or thermal radiation. Nevertheless, a slight convective or radiative thermal transfer may also take place depending on the respective design of the cooling device. However, thermal conduction provides the main contribution to the respective thermal transfer or cooling process. For example, thermal conduction contributes more than 50%, more than 75%, more than 90% or essentially 100% to the cooling of the element or elements. In any case, the element and the metal plate are in thermally conductive contact.

Furthermore, the proposed solution provides advantages in comparison with the initially mentioned option of using a conventional cooling compressor for cooling the at least one element. A cooling compressor comprises many movable parts and therefore requires intensive maintenance whereas the proposed solution merely needs lines for the cryogenic gas, which require hardly any maintenance. In addition, no climate-damaging coolant has to be used and the costs for the operation of the cooling device are significantly lower because the liquid nitrogen, for example, can be simply removed from a reservoir and heated to the required temperature. In conventional cooling by means of a compressor, in contrast, the energy input increases proportionally as the temperature to be reached decreases. At this point, it should be noted that the temperatures to be reached may lie, for example, in a range between 140 K and 220 K (exit and entry of the element) in order to achieve optimal cooling and in the present case a desired adjustment of retained austenite in a metal strip, wherein the temperature of the liquid nitrogen lies, for example, at 77 K depending on the pressure. In contrast, conventional cooling compressors typically only reach minimal temperatures of about 190 K.

The cooling device advantageously comprises a gas line for cryogenic gas, which branches off the cooling channel at an end on the discharge side and is designed for conveying cryogenic gas into a region above the first side of the metal plate. For this purpose, the gas line may be correspondingly routed in the cooling device. As already mentioned above, the inventive solution makes it possible to reuse the gas. Icing on the element is prevented in that gaseous nitrogen, which accumulates during the course of the cooling process anyway, is respectively conveyed onto the at least one element or the metal plate and the corresponding region is thereby rendered inert. Relevant regions in this context advantageously are an entry region for the at least one element into the cooling device above the first side of the metal plate and/or an exit region for the at least one element from the cooling device because the risk of icing is particularly high in these regions.

Furthermore, the cooling device advantageously comprises at least one metal cover plate, which can be arranged above the metal plate in such a way that a channel for the at least one element, particularly a narrow channel, can be formed between the metal plate and the metal cover plate. For this purpose, the metal cover plate (or multiple metal cover plates distributed over the moving direction of the element) may be provided with webs on the lateral edges such that the metal cover plate laterally rests on the metal plate and forms an intermediate space for the at least one element. In this way, the at least one element can be cooled in an enhanced and more uniform manner because the metal cover plate is likewise cooled via the cooling channel and the metal plate. If multiple elements should be cooled, it is also possible to form separate channels for the individual elements, particularly contoured channels, between the metal plate and the metal cover plate.

It is advantageous if the cooling channel at least sectionally extends from an exit side of the at least one element to an entry side of the at least one element in a winding manner. This makes it possible to cool the metal plate and the element as uniformly as possible. In this case, the cooling channel may be realized in the form of windings, for example in a meandering manner, in order to thereby cool the metal plate as uniformly as possible. It is particularly advantageous if the flow direction of the cryogenic gas in the cooling channel extends from the exit side to the entry side because the nitrogen, for example, is already in its gaseous state on the entry side of the strip and therefore has a lower cooling effect than on the exit side of the element, on which the nitrogen is still liquid. This arrangement particularly corresponds to the principle of a countercurrent heat exchanger. In this way, the element can be increasingly cooled from the entry side toward the exit side.

Furthermore, the cooling device advantageously comprises an external housing, in which the metal plate and the cooling channel are arranged, wherein the metal plate, the cooling channel and the at least one element are in the circumferential direction of the at least one element surrounded by an insulation housing made of thermally insulating material, particularly glass-fiber reinforced plastic (GRP). The metal plate with the cooling channel, i.e. the heat exchanger element, therefore has no direct contact with the external housing. Losses due to thermal conduction can thereby be reduced because the cooled components are thermally separated from the external housing. In this context, it is advantageous if the insulation housing is only connected to the external housing at discrete locations. The contact required for a stable mounting can thereby be achieved and the losses due to thermal conduction can be additionally reduced. The gas line for the inerting process can be advantageously routed to the corresponding region through the insulation housing in this case.

It is advantageous if the external housing and the insulation housing respectively comprise a bottom part and a cover. In this case, the bottom parts of the external housing and the insulation housing may be connected to one another, wherein the covers of the external housing and the insulation housing may likewise be connected to one another. In this way, the at least one element can be very easily placed into the cooling device because the insulation housing is opened simultaneously with opening the external housing.

An inventive hardening device serves for hardening at least one element passing through said hardening device and comprises an inventive cooling device, as well as a furnace and a control valve. In this case, the furnace is arranged upstream of the cooling device referred to the moving direction of the at least one element and consequently can be used for initially heating and thereby hardening the element. A gas line for cryogenic gas is provided and makes it possible to convey gas being discharged from the cooling channel of the cooling device into the furnace. The gas can be used for forming an inert gas atmosphere in the furnace, if applicable by admixing, for example, hydrogen ($H_2$). The control valve is arranged downstream of a discharge point of the cryogenic gas from the cooling channel and can be used for controlling a flow of cryogenic gas through the cooling channel and/or at least one temperature in the cooling device. The control itself may be realized, for example, by means of a suitable computer unit and a motor, which is actuated by said computer unit and serves for adjusting the control valve. The size of the flow-through opening in the control valve therefore serves as manipulated variable for the control. In this respect, it is advantageous to use a control valve in the form of a proportional valve.

In the proposed hardening device, the cryogenic gas can therefore be reused after the cooling process, for example for the formation of an inert gas atmosphere in the furnace, in which nitrogen, for example, is required anyway. The cooling device can thereby be used even more efficiently. It is particularly advantageous if the entire gas used for the cooling process is reused, namely for the inert gas atmosphere in the furnace and/or the inerting process in the cooling device. The respective control of the flow of cryogenic gas or of the temperature by means of the control valve on the discharge side represents a particularly simple control because a gas flow at room temperature can be adjusted easier than a flow, for example, of liquid nitrogen, which is typically present in the form of a two-phase flow. The aforementioned temperatures at the entry and the exit of the strip into and from the cooling device particularly may be considered as temperatures to be controlled in this case. The temperature of the element itself may likewise be used as controlled variable.

An inventive method serves for contact cooling at least one passing element, wherein an inventive cooling device or hardening device is particularly used. In this case, the at least one element is guided along a first side of a metal plate in a thermally conductive manner, wherein the metal plate is cooled by conveying cryogenic gas through a cooling channel, which is connected to the metal plate in a thermally conductive manner.

With respect to other advantageous embodiments and advantages of the proposed method, we refer at this point to the preceding descriptions of the inventive cooling device and hardening device in order to avoid unnecessary repetitions.

EMBODIMENT OF THE INVENTION

Figure 1:
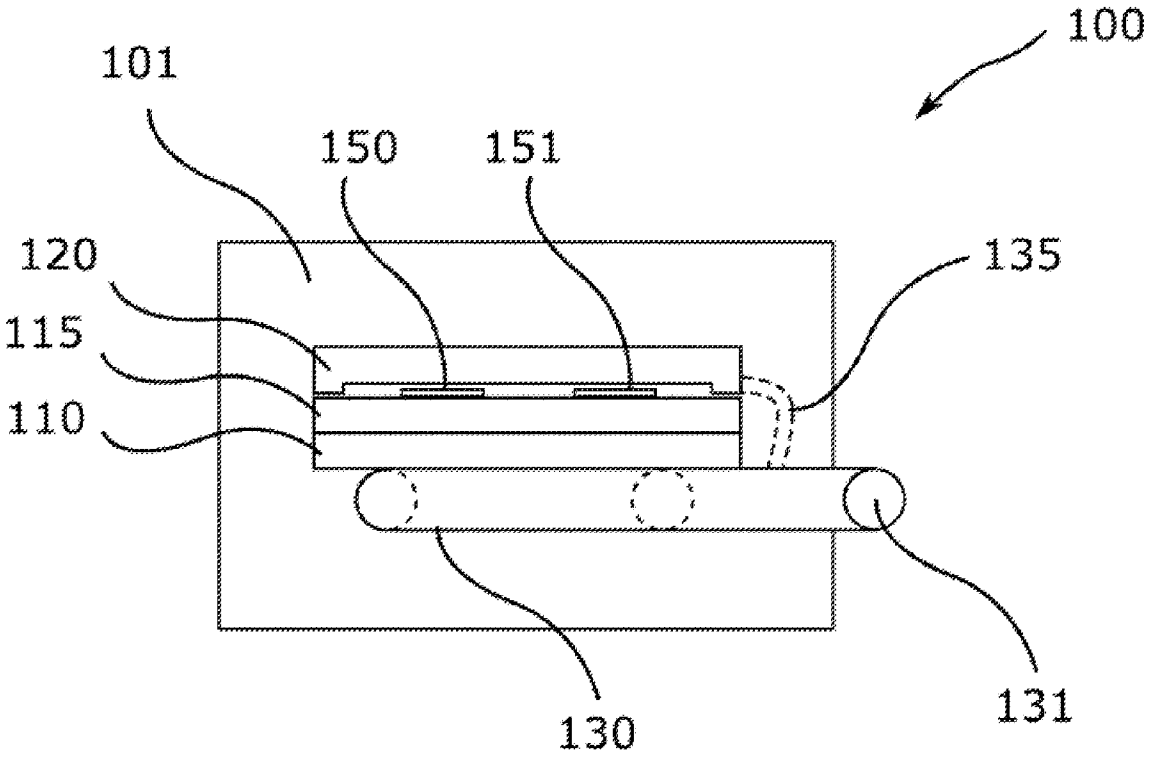
FIG. 1 schematically shows a preferred embodiment of an inventive cooling device.

FIG. 1 schematically shows a preferred embodiment of an inventive cooling device 100, in this case in the form of a cross-sectional view, wherein this cooling device is also suitable for carrying out an inventive method. The cooling device 100 presently comprises a housing 101, in which a metal plate 115 made, e.g., of brass is arranged. For example, two metal strips 150, 151 can be guided along the metal plate (perpendicular to the plane of projection) on a first, upper side of the metal plate 115.

This figure furthermore shows an intermediate plate 110 that is made, e.g., of copper and connected to a cooling channel 130 in a thermally conductive manner. In this case, the cooling channel is respectively realized in the form of a pipeline or cooling line. The cooling line 130, which is likewise made, e.g., of copper, comprises a connection 131 for introducing liquid nitrogen or other cryogenic gases. The connection for discharging gaseous nitrogen is not visible in this illustration. With respect to a connection of the cooling device or the cooling line to a nitrogen circuit, we otherwise refer to FIG. 5.

The intermediate plate 110 is furthermore connected to the metal plate 115 in a thermally conductive manner. The cooling line 130 is therefore connected to a second side of the metal plate 115, in this case its lower side, in a thermally conductive manner. In this way, the metal plate 115 and therefore the metal strips 150, 151 being guided along said metal plate are cooled via the intermediate plate 110 when liquid nitrogen or other cryogenic gases flow through the cooling line 130 and evaporate in the process. All in all, this cooling process therefore concerns indirect contact cooling with liquid nitrogen or other cryogenic gases.

It should be noted that the cooling channel could also be milled into the intermediate plate 110 or the metal plate 115 and covered instead of providing a cooling line 130.

This figure furthermore shows a metal cover plate 120, which may likewise be made, e.g., of brass and can be arranged above the metal plate 115 in such a way that a channel for the metal strips 150, 151 is formed between the metal plate 115 and the metal cover plate 120. For this purpose, the side of the metal cover plate 120 facing the metal plate 115, in this case its lower side, comprises webs on its lateral ends, by means of which the metal cover plate can be placed onto the metal plate 115.

This figure furthermore shows a gas line 135, e.g., for gaseous nitrogen, wherein said gas line branches off an end of the cooling line 130 on the discharge side and is oriented over a region above the first side of the metal plate 115, i.e. at the strips 150, 151. In this way, the gaseous nitrogen can be at least partially reused after the cooling process, namely for inerting the region above the metal plate 115 or the metal strips 150, 151 in order to prevent icing due to condensation water formed during a cooling process. The gaseous nitrogen does not serve for cooling the metal strips 150, 151. The metal strips are almost completely or at least essentially cooled due to their contact with the cooled metal plate 115.

It should furthermore be noted that insulation material may be provided in the housing 101 of the cooling device 110 in order to insulate the cooled components from the ambient heat and to thereby realize a more efficient cooling process.

Figure 2:
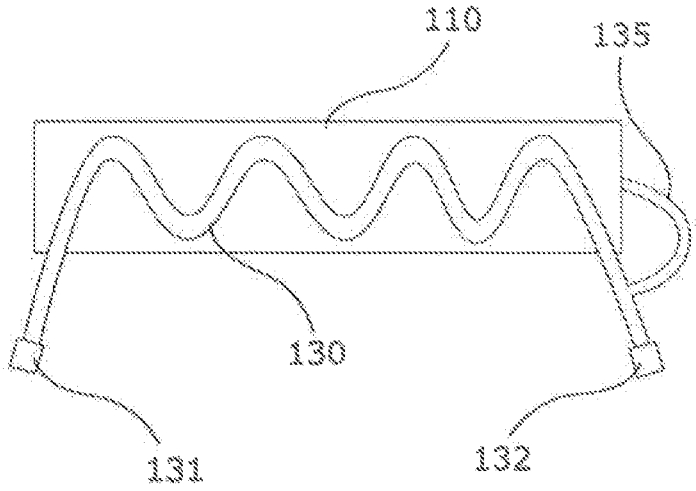
FIG. 2 schematically shows a detail of the cooling device according to FIG. 1.

FIG. 2 shows the intermediate plate 110 according to FIG. 1 from below (referred to the illustration in FIG. 1). The cooling line 130, which comprises, for example, a few meandering windings, is illustrated in greater detail in this figure. For example, the cooling line may be soldered or welded onto the intermediate plate 110 and/or fixed thereon by means of clamps or the like. This figure also shows the connection 131 for introducing liquid nitrogen or other cryogenic gases into the cooling line 130 and the connection 132 for discharging gaseous nitrogen from the cooling line 130.

This figure furthermore shows the gas line 135, by means of which gaseous nitrogen can be respectively removed from or branched off the cooling line 130 on its discharge side and used for inerting purposes—as already explained above with reference to FIG. 1. It goes without saying that a valve, for example a throttle valve, may also be respectively provided at the branching or in the gas line 135 in this case in order to adjust the desired amount of gas.

Figure 3:
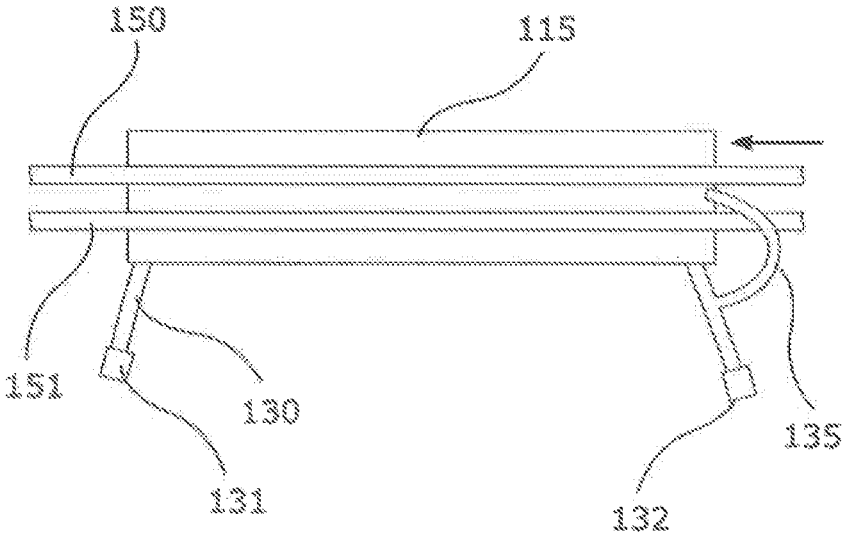
FIG. 3 schematically shows another detail of the cooling device according to FIG. 1.

FIG. 3 shows the metal plate 115 according to Figure from above (referred to the illustration in FIG. 1). The metal strips 150 and 151 being guided along the metal plate 115 are illustrated in greater detail in this figure. The process flow direction of the metal strips is indicated with an arrow. In this case, the metal plate 115 may have a length, for example, of about 1 m (in the process flow direction).

This figure furthermore shows that the connection 131 for introducing liquid nitrogen or other cryogenic gases is arranged on the exit side of the metal strips and the connection 132 for discharging gaseous nitrogen is arranged on the entry side of the metal strips. In this way, the exit side is cooled more intensely than the entry side such that the passing metal strips are altogether efficiently cooled.

In addition, this figure once again shows the gas line 135, by means of which gaseous nitrogen can be respectively conveyed onto the upper side of the metal plate 115 or onto the metal strips 150, 151 for inerting purposes. It goes without saying that multiple gas outlet openings may also be provided on the gas line 135 and distributed over the length of the metal plate 115 in the process flow direction.

Figure 4:
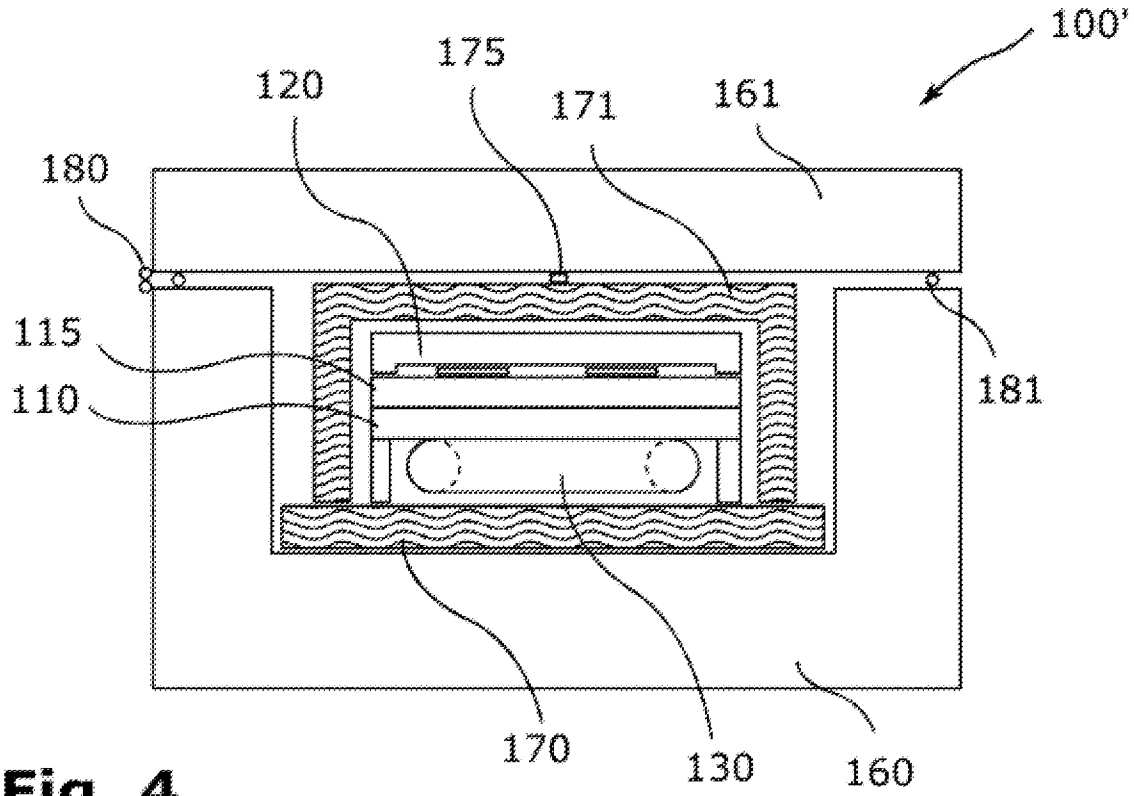
FIG. 4 schematically shows another preferred embodiment of an inventive cooling device.

FIG. 4 schematically shows another preferred embodiment of an inventive cooling device 100'. The heat exchanger unit, which in this case comprises the metal plate 110, the intermediate plate 115, the metal cover plate 120 and the cooling channel 130 (in this case without connections), is arranged on a bottom part 170 of an insulation housing by means of supports. A cover 171 of the insulation housing is arranged on the bottom part such that the heat exchanger unit is surrounded by the insulation housing.

The insulation housing may be made, for example, of glass-fiber reinforced plastic (GRP) that acts in a thermally insulating manner. The insulation housing is in turn arranged in an external housing of the cooling device 100', which comprises a bottom part 160 and a cover 161. In this case, the bottom part 170 of the insulation housing is arranged directly on the bottom part 160 of the external housing whereas the cover 171 of the insulation housing is only connected to the cover 161 of the external housing at individual discrete locations, one of which is as an example identified by the reference symbol 175, such that a gap remains between the covers and losses due to thermal conduction are minimized.

The cover 171 of the insulation housing is opened simultaneously with opening the cover 161, which is connected to the bottom part 160 of the external housing by means of a hinge 180. In the closed state, the external housing is sealed by means of the seals 181 between the bottom part 160 and the cover 161. In addition, the cover 171 and the bottom part 170 of the insulation housing should be adapted to one another in such a way that the heat exchanger unit is surrounded as completely as possible. It goes without saying that openings for the at least one element have to be provided at the entry and the exit.

In this way, the external housing can be manufactured in a particularly cost-effective manner because its insulation is not as important as in instances, in which no insulation housing is used. The external housing particularly may also be welded such that no moisture can penetrate.

Figure 5:
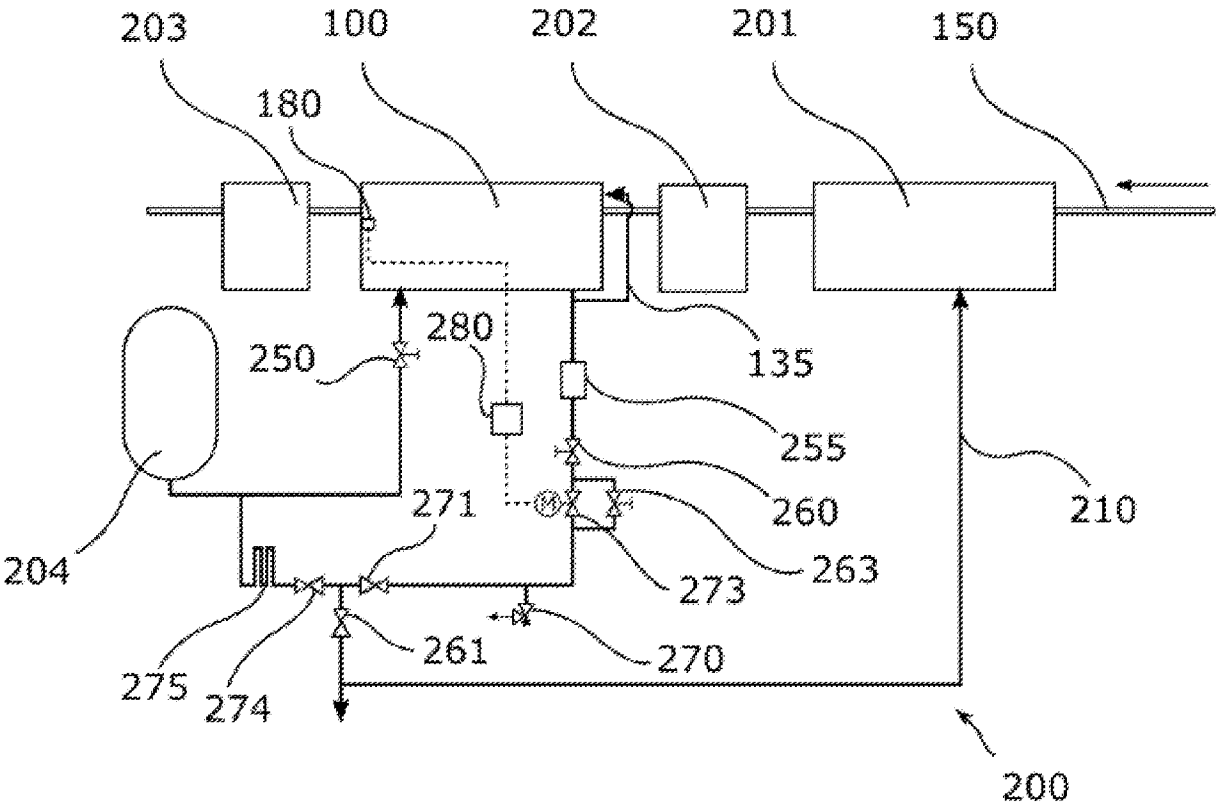
FIG. 5 schematically shows a preferred embodiment of an inventive hardening device.

FIG. 5 schematically shows a preferred embodiment of an inventive hardening device 200 in the form of a flow chart, wherein this hardening device is also suitable for carrying out an inventive method. The hardening device comprises a furnace 201, through which the metal strip 150 (in contrast to FIGS. 1 and 3, only one metal strip is illustrated in this figure in order to provide a better overview) initially passes along the process flow direction (indicated with an arrow).

Subsequently, the metal strip 150 passes through a quenching device 202, in which the metal strip 150 is shock-cooled, the cooling device 100 and ultimately a tempering device 203. The cooling device 100 is realized in the form of a cooling device of the type described above with reference to FIGS. 1 to 3. In this respect, we also refer to the corresponding explanations. However, the cooling device 100' according to FIG. 4 could also be used.

This figure furthermore shows a tank 204 for liquid nitrogen, from which liquid nitrogen can be removed and supplied to the cooling device 100 via a shut-off valve and/or throttle valve 250. This can be realized with a suitable line, preferably an insulated line, which can be connected to the connection 131 illustrated in FIGS. 1 to 3 and therefore to the cooling line 130.

Gaseous nitrogen can now exit the cooling device 110 via a heat exchanger 255. The gas line 135, through which part of the gaseous nitrogen can be removed, is indicated outside the cooling device 100 in this figure in order to provide a better overview.

The gaseous nitrogen remaining downstream of the branching can now be heated in the heat exchanger 255. An electric heating device may also be provided alternatively to the heat exchanger.

Subsequently, the gaseous nitrogen is conveyed through a throttle valve 260 and a control valve 273. In this case, a bypass is provided via the shut-off valve and/or throttle valve 263. The control valve 273 presently comprises a motor-driven actuating drive, which in turn may be activated, for example, by means of a computer unit 280.

The computer unit 280 is furthermore designed for detecting a temperature in the cooling device 100, for example by means of a temperature sensor 180 at the exit of the metal strip 150 in the cooling device 100. This temperature can now be controlled in such a way that a flow-through opening of the control valve 273 is used as manipulated variable. In this way, the temperature in the cooling device can be controlled by adapting the flow of gaseous nitrogen from the cooling line, which also affects the flow of liquid nitrogen. It goes without saying that the temperature at the exit of the metal strip can also be controlled in this way.

Desirable temperatures at the exit of the metal strip lie, for example, at about 140 K to 150 K. In this way, the best retained austenite conversion possible can take place in the metal strip on the one hand and excessive icing can be prevented on the other hand.

The gaseous nitrogen can furthermore be supplied to other consumers via the valves 271 and 261 and, in particular, to the furnace 201 via the gas line 210. In this case, a safety valve or pressure control valve 270, which opens, e.g., starting at a pressure of 13.5 bar, may also be provided.

The supply for the additional consumers or the furnace may also be connected to a supply line from the tank 204 via an evaporator 275 and a valve 274. In this way, a potentially incorrect amount of gaseous nitrogen for the additional consumers or the furnace 201 can be replenished from the tank 204.

In order to ensure a reliable gas flow, the valves 261, 274 and 271 may be designed for only releasing the blackflow starting at pressures of 12 bar, 12.5 bar and 13 bar (in this sequence). It goes without saying that different pressure values may also be used in ascending sequence.

The gaseous nitrogen can now be used for forming an inert gas atmosphere in the furnace 201. In this way, the gaseous nitrogen produced during the course of cooling the metal strip can be reused—in addition to its use for inerting purposes. All in all, a very energy-efficient and environmentally compatible method for cooling metal strips is thereby realized.

The invention claimed is:

1. A cooling device (100) for cooling at least one element (150, 151) passing through said cooling device, said cooling device comprising:

a metal plate (115) with a first side and a second side and a cooling channel (130) for a cryogenic gas, wherein the first side of the metal plate (115) is adapted to permit at least one element (150, 151) to be guided along the first side of the metal plate (115) in thermally conductive contact with the first side of the metal plate (115), wherein the cooling channel (130) is at least sectionally connected to the metal plate (115) in a thermally conductive manner, and wherein the cooling channel (130) comprises a first connection (131) on a first end thereof for introducing a cryogenic gas, and a second connection (132) on a second end thereof for discharging the cryogenic gas.

2. The cooling device (100) according to claim 1, further comprising a gas line (135), which branches off from the cooling channel (130) at a second end thereof, for conveying cryogenic gas from the cooling channel (130) into a region above the first side of the metal plate (115).

3. The cooling device (100) according to claim 2, wherein the region above the first side of the metal plate (115) comprises an entry region for introducing the at least one element (150, 151) into the cooling device (100) and/or an exit region for withdrawing the at least one element (150, 151) from the cooling device (100).

4. The cooling device (100) according to claim 1, further comprising at least one metal cover plate (120) which is arranged above the metal plate (115) in such a way that a channel for the at least one element (150, 151) is formed between the metal plate (115) and the metal cover plate (120).

5. The cooling device (100) according to claim 1, wherein the cooling channel (130) at least sectionally extends from an exit side of the at least one element (150, 151) to an entry side of the at least one element (150, 151) in a winding manner.

6. The cooling device (100) according to claim 1, wherein the cooling channel (130) comprises a pipeline, or is machined into the metal plate (115), or is machined into an additional metal plate, which is connected to the metal plate (115) in a thermally conductive manner.

7. The cooling device (100) according to claim 1, wherein the at least one element (150, 151) comprises a strip or a wire.

8. The cooling device (100) according to claim 1, wherein the cryogenic gas comprises liquid and/or gaseous nitrogen.

9. The cooling device (100) according to claim 1, further comprising an external housing (160, 161), in which the metal plate (115) and the cooling channel (130) are arranged, wherein the metal plate (115) and the cooling channel (130) are surrounded by an insulation housing (170, 171) of thermally insulating material, and wherein the insulation housing (170, 171) is only connected to the external housing (160, 161) at discrete locations.

10. The cooling device according to claim 9, wherein the external housing (160, 161) and the insulation housing (170, 171) respectively comprise a bottom part (160, 170) and a cover (161, 171), wherein the bottom part of the external housing and the bottom part of the insulation housing are connected to one another, and wherein the cover of the housing and the cover of the insulation housing are connected to one another.

11. A hardening device (200) for at least one element (150) passing through said hardening device, said hardening device comprising:

a cooling device (100) according to claim 1 a furnace (201) and a control valve (273), wherein the furnace (201) is arranged upstream of the cooling device (100) referred to the moving direction of the at least one element (150), wherein a gas line (210) for cryogenic gas is provided and makes it possible to convey cryogenic gas being discharged from the cooling channel (130) of the cooling device (100) into the furnace (201), and wherein the control valve (273) is arranged downstream of a discharge point of the cryogenic gas from the cooling channel (130) and can be used for controlling a flow of cryogenic gas through the cooling channel (130) and/or at least one temperature in the cooling device (100).

12. A method for cooling at least one passing element (150) using a cooling device (100) according to claim 1, wherein the at least one element (150, 151) is guided along a first side of the metal plate (115) and is in thermally conductive contact with the first side of the metal plate (115), and wherein the metal plate (115) is cooled by conveying cryogenic gas through a cooling channel (130), which is connected to the metal plate (115) in a thermally conductive manner, in order to indirectly cool the passing element (150).

13. The method according to claim 12, wherein cryogenic gas being discharged from the cooling channel (130) is made available to at least one other application through which the at least one element (150) passes, in order to form an inert gas atmosphere in the furnace (150).

14. The method according to claim 12, wherein a strip is used as the at least one element (150, 151).

15. The method according to claim 12, wherein hydrogen is used as cryogenic gas, and wherein the hydrogen is introduced into the cooling channel (130) in liquid form and discharged from the cooling channel (130) in gaseous form.

16. A method for cooling at least one passing element (150) using a hardening device (100) according to claim 11, wherein the at least one element (150, 151) is guided along a first side of the metal plate (115) and is in thermally conductive contact with the first side of the metal plate (115), and wherein the metal plate (115) is cooled by conveying cryogenic gas through the cooling channel (130), which is connected to the metal plate (115) in a thermally conductive manner, in order to indirectly cool the passing element (150).

17. The cooling device according to claim 1, wherein the cooling channel (130) is at least sectionally connected to the second side of the metal plate (115) in a thermally conductive manner.

18. The cooling device (100) according to claim 1, wherein the at least one element (150, 151) comprises a metal strip.

19. The cooling device (100) according to claim 9, wherein the thermally insulating material is glass-fiber reinforced plastic.

20. The cooling device (100) according to claim 1, wherein passage of the cryogenic gas through the cooling channel provides for indirect cooling of the metal plate (115) by the cryogenic gas flowing through the cooling channel (130).

21. A cooling device (100) for cooling at least one element (150, 151) passing through said cooling device, said cooling device comprising:

a housing (101), a metal plate (115) with a first side and a second side and a cooling channel (130) for a cryogenic gas, and a passage within said housing for passing at least one element (150, 151) to be cooled through the housing and along the first side of the metal plate (115) in thermally conductive contact with the first side of the metal plate (115), wherein the cooling channel (130) is at least sectionally connected to the metal plate (115) in a thermally conductive manner, and wherein the cooling channel (130) comprises a first connection (131) on a first end thereof for introducing a cryogenic gas, and a second connection (132) on a second end thereof for discharging the cryogenic gas.

22. The cooling device (100) according to claim 21, wherein said passage is formed as a channel between a metal cover plate (120), arranged above the metal plate (115), and the metal plate (115).

* * * * *